United States Patent [19]

Kulzer

[11] 4,280,298

[45] Jul. 28, 1981

[54] TOY MODEL FLYING MACHINE

[76] Inventor: Walter P. B. Kulzer, 7309 Coronet Ave., Fort Worth, Tex. 76118

[21] Appl. No.: 87,095

[22] Filed: Oct. 22, 1979

[51] Int. Cl.[3] ..... A63H 27/00

[52] U.S. Cl. ..... 46/78; 46/82

[58] Field of Search ..... 46/78, 79, 74 R, 76 R, 46/75, 82, 74 A, 81, 74 B; 244/16

[56] References Cited

U.S. PATENT DOCUMENTS

| | | | |
|---|---|---|---|
| 1,348,971 | 8/1920 | Thurnau | 46/78 |
| 2,957,272 | 10/1960 | Berzack et al. | 46/74 A X |
| 3,025,846 | 3/1962 | Crosman | 46/74 B |
| 3,174,252 | 3/1965 | Sunray | 46/78 |
| 3,713,249 | 1/1973 | Goodman | 46/74 R |

OTHER PUBLICATIONS

"Nutnik", *American Modeler*, vol. 52, No. 6, 9/1959, pp. 12, 13, 57.

*Primary Examiner*—G. E. McNeill
*Assistant Examiner*—Mickey Yu
*Attorney, Agent, or Firm*—Arthur F. Zoballzer

[57] ABSTRACT

A model airplane comprising an elongated body rectangular in cross-section having a propeller coupled to one end which is rotatable by an elastic band. Two thin elongated fins are adapted to be removably attached to the body at positions such that they form a cross with their thin planes being 90 degrees apart and their lengths being generally perpendicular to the length of the body with one fin being located its full width closer to said one end of the body than the other fin.

5 Claims, 1 Drawing Figure

TOY MODEL FLYING MACHINE

FIELD OF THE INVENTION

The present invention relates to a model airplane.

SUMMARY OF THE INVENTION

It is an object of the present invention to provide a novel model airplane comprising a substantially straight elongated body having a first end and a second opposite end and two thin elongated fins adapted to be removably attached to said body at positions intermediate said first and second ends such that they form a cross with their thin planes being about 90 degrees apart and their lengths being generally perpendicular to the length of said body.

A propeller is mounted for rotation at said first end and elastic means is coupled to said propeller and to said body at a position between said two fins and said second end of said body.

In a further aspect the two fins are removably attachable to the body at different positions along its length. The propeller is mounted such that it is of a pusher type.

DESCRIPTION OF THE PREFERRED EMBODIMENT

Figure 1:
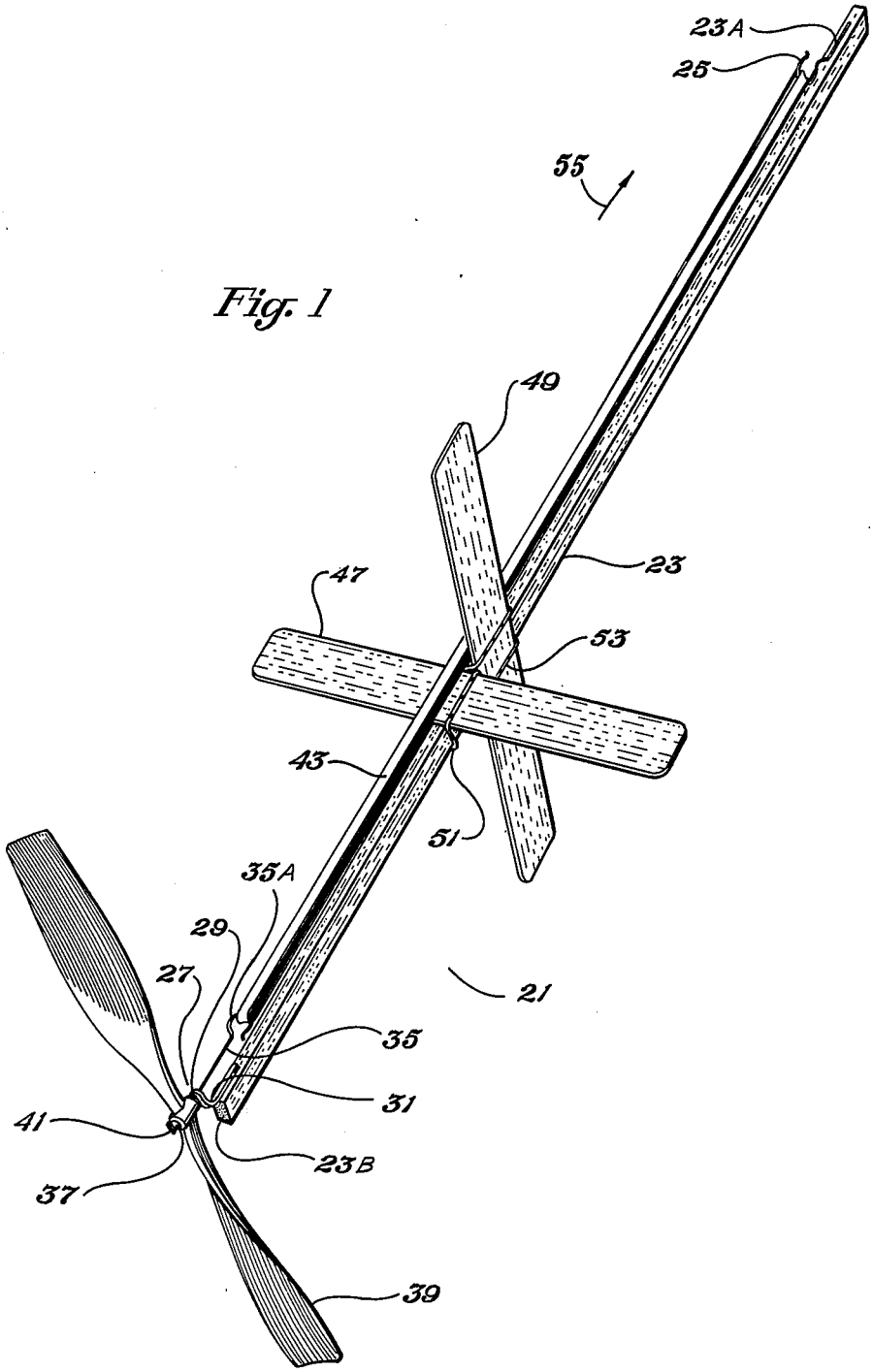
FIG. 1 is a perspective view of the model airplane of the present invention.

Referring to the drawing, the model airplane of the present invention is identified by reference numeral 21 and is defined as a flying stick. It comprises a fuselage or body 23 formed of a stick ¼ inch by ⅜ inch by 18 inches in length, constructed from either balsa, spruce or plastic. At the forward end 23A of this stick, a 0.025" music wire hook 25 is securely attached, employing either model airplane cement (Ambroid) or epoxy glue. A thrust bearing 27 is constructed from a piece of hard aluminum 0.031 inches thick by 0.062 inches wide and 1½ inches long. It can also be constructed from one leg of a 1/16 inch by 2 inch cotter pin. A 0.025 inch diameter hole 29 is drilled through the material, 1/16 inch from one end. Then a 90 degree angle bend 31 is formed ¼ inch from this hole. It is then cemented to the aft end 23B of the stick with the 90 degree angle bend overhanging the stick ¼ inch. A propeller shaft 35 is constructed from 0.025 inch music wire. It is 1½ inches long with an eye 35A ¼ inch in diameter on one end. The eye is formed with a pair of round nose pliers. The straight part of the wire is passed through the hole 29 in the thrust bearing 27 and is then passed through a propeller shaft hole 37 of a 7 inch diameter by 4 inch pitch plastic propeller 39. ¼ inch of the propeller shaft 35 protruding through the propeller shaft hole 37 is then bent back toward the propeller in an "U" shape 41. This then serves to lock the propeller shaft 35 to the propeller 39. Between the eye 35A in the propeller shaft 35 and the forward mounted hook 25, are fastened two loops of rubber strip 0.040 inch thick by 0.125 inch wide by 16 inches in length. Only one rubber loop 43 is shown. These rubber loops supply the energy to turn the propeller. The stick 23 with propeller 39 and rubber loops 43 attached, is then placed on a knife edge and moved forward or backward until it balances. A mark is placed at this place on the stick where the knife edge rests. This location on the stick is the Center of Gravity. At the Center of Gravity location on the stick are mounted two stabilizing fins 47 and 49 with their planes 90 degrees apart. They are tied to the stick with small rubber bands 51 and 53 with one mounted on top of the stick which is ¼ inch wide and the other aft or forward of it on the side of the stick where the measurement is ⅜ inch. The stabilizing fins are 1/16 inch thick by ¾ inch wide by 6 inches in length and are constructed of either balsa, spruce or plastic. A line should be marked in the center of their long dimension, that is 3 inches from each end. This line should be aligned with the center lines of the top and side of the stick so that there will be equal areas of stabilizing fin on either side of the stick.

DIRECTIONS FOR PREPARING THE FLYING STICK FOR FLIGHT AND FLYING

The stabilizing fins 47 and 49 are attached to the stick 23 with the small rubber bands 51 and 53, one on top of the stick (¼ inch dimension) and the other mounted aft of it on the side of stick (⅜ inch dimension) with a gap of ⅛ inch between the fins. The stabilizing fins should be positioned with the aft most fin, 5¾ inches from the propeller end of the stick. The rubber loops 43 are attached to the front rubber loop support hook 25 and to the eye 35A, in the propeller shaft 35. The stick 23 is then held with the thumb and fingers of the left hand, between the stabilizing fins 47 and 49 and the propeller 39. The propeller 39 is then rotated counter clockwise with the index finger of the right hand 275 turns. The right hand continues to hold the propeller to keep it from spinning and the left hand maintains its position on the stick. The flying stick is then held out in front of the body and with the stick pointed straight up, the propeller is released and then the stick is released. The flying stick will then ascend straight up several hundred feet until the turns in the rubber loops are completely unwound, whereupon it will descend slowly propeller first to the ground. If the flying stick spirals up on this first flight, the stabilizing fins should be moved toward the propeller end of stick about ⅛ inch at a time on each succeeding launch until a perfectly vertical flight path is achieved. If on the first launch, the flying stick tilts over and flies in an arched trajectory, the stabilizing fins should be moved away from the propeller end of the stick, ⅛ inch at a time until the vertical flight path is achieved. The setting that achieves the vertical flight path, should be marked on the stick. By moving the stabilizing fins ½ inch away from the propeller end of the stick from this mark will produce a spiral flight path, while moving them ½ inch in the opposite direction (toward the propeller end of the stick) will produce an arched or trajectory arc flight path.

The stabilizing fins 47 and 49 serve two functions. They counteract the torque of the propeller and they act to control and stabilize the flight path. Since they are mounted on the stick 23 90 degrees from each other and in flight with the propeller turning clockwise, the stick rotates slowly counter clockwise. This results in the stabilizing fins providing stability along the vertical, horizontal and lateral axes. The propeller 39 provides thrust to move the flying stick through the air. It is a pusher type and rotates clockwise when viewed from behind the propeller. The direction of flight of the flying stick 21 is indicated by arrow 55. The rubber loops 43 provide the energy to turn the propeller. The rubber loops are constructed of two pieces of rubber strip each 0.040 inch thick by 0.125 inch wide and 34 inches long. The ends of each strip are tied together with a square knot to form a loop. These rubber loops are then connected to the hook 35A on the end of the propeller shaft and the front rubber loop support hook 25. The thrust bearing 27 supports the propeller shaft 35. The thrust bearing is constructed of either hard aluminum or dural or one leg of a 1/16 inch by 2 inches cotter pin with a right angle bend 5/16 inch from one end and with a 0.025" hole drilled 1/16 inch from the end of the 5/16 inch portion. The flat side of cotter pin leg is cemented to the end of the stick or fuselage with ¼ inch over hanging. Epoxy or model airplane cement (Ambroid) is used as an adhesive.

The flying stick operates as follows. The rubber loops when wound tightly unwind when the propeller is released. Energy is then supplied to the propeller shaft which transfers it to the propeller causing it to rotate. The propeller then supplies enough thrust to overcome the total weight of the flying stick. The stabilizing fins supply stability along the lateral axis by their location on the center of gravity with relationship to the forward and aft moment arms of the stick. While the rubber is unwinding in one direction an opposite force or torque is created. This force or torque opposite to the direction of rotation of the propeller causes the stick to rotate in a direction opposite to the propeller rotation. This imparts a spin to the stabilizing fins. The rate of spin is controlled by the area of the stabilizing fins. Too much area in the stabilizing fins would result in too slow a rotation and a loss of stability along the vertical and horizontal axes. Too little area in the stabilizing fins allows the stick to rotate too fast thereby reducing the duration of the flight.

Thus my invention which I call a flying stick is a toy model flying machine. It will rise vertically to great heights or with a slight adjustment of the stabilizing fins, will fly in a trajectory arc of great distances or by still another adjustment of the stabilizing fins, will rise in a spiral and fly in a circular flight path. It clearly demonstrates how various laws of physics and aerodynamics operate.

I claim:

1. A model airplane, comprising:

a substantially straight elongated body having a first end and a second opposite end, two thin elongated fins adapted to be removably attached to said body at positions intermediate said first and second ends such that they form a cross with their thin planes being about 90 degrees apart and with their lengths being generally perpendicular to the length of said body, a propeller mounted for rotation at said first end, and elastic means coupled to said propeller and to said body at a position between said two fins and said second end of said body, said elastic means being capable of rotating said propeller for causing said model airplane to fly, said two fins being adapted to be removably attached to said body such that one fin is located its full width closer to said first end of said body than said other fin.

2. The model airplane of claim 1 wherein said body comprises structure which allows said two fins to be removably attached thereto at different positions along its length.

3. A model airplane, comprising:

a substantially straight elongated body having a first end and a second opposite end, two thin elongated fins adapted to be removably attached to said body at positions intermediate said first and second ends such that they form a cross with their thin planes being about 90 degrees apart and with their lengths being generally perpendicular to the length of said body, a propeller mounted for rotation at said first end, and elastic means coupled to said propeller and to said body at a position between said two fins and said second end of said body, said elastic means being capable of rotating said propeller for causing said model airplane to fly, said body being rectangular in a cross-section perpendicular to the length of said body between said first and second ends, said two fins being adapted to be removably attached to two perpendicular sides of said body by elastic means, said two fins being removably attachable to said body at different positions along its length.

4. The model airplane of claim 3 wherein said propeller is mounted at said first end such that it is of a pusher type and causes said model airplane to fly with said second end forward.

5. The model airplane of claims 3, or 4, wherein said two fins are attachable to said body such that one fin is located its full width closer to said first end of said body than said other fin.

* * * * *